United States Patent [19]

Tabuchi

[11] Patent Number: 4,614,495

[45] Date of Patent: Sep. 30, 1986

[54] APPARATUS FOR SOAKING STEEL PIECES

[75] Inventor: Seigo Tabuchi, Narashino, Japan

[73] Assignee: Kabushiki Kaisha Itoh Seitetsusho, Tokyo, Japan

[21] Appl. No.: 688,589

[22] Filed: Jan. 3, 1985

[30] Foreign Application Priority Data

Sep. 17, 1984 [JP] Japan ..... 59-194255

[51] Int. Cl.[4] ..... F27B 3/04; F27B 9/02

[52] U.S. Cl. ..... 432/164; 432/11; 432/128

[58] Field of Search ..... 432/11, 128, 163, 164

[56] References Cited

U.S. PATENT DOCUMENTS

| | | | |
|---|---|---|---|
| 568,847 | 10/1896 | Grove et al. | 432/164 |
| 1,913,197 | 6/1933 | Freeland | 432/164 |
| 2,799,491 | 7/1957 | Rusciano | 432/163 |
| 4,311,454 | 1/1982 | Tabuchi | 432/11 |

FOREIGN PATENT DOCUMENTS

| | | | |
|---|---|---|---|
| 2706345 | 8/1978 | Fed. Rep. of Germany | 432/128 |

*Primary Examiner*—John J. Camby

*Attorney, Agent, or Firm*—Scully, Scott, Murphy & Presser

[57] ABSTRACT

An apparatus for soaking steel pieces including cold steel pieces and hot steel pieces. The apparatus is of the type which includes: a soaking furnace for subjecting the steel pieces to a soaking treatment; a preheating chamber for preheating the cold steel pieces before the cold steel pieces are introduced into the soaking furnace, the preheating chamber being connected to the soaking furnace for receiving waste heat from the soaking furnace for the preheating treatment and having an outlet portion for discharging the cold steel pieces; and a mechanism for introducing the steel pieces into the soaking furnace and for advancing the steel pieces through the soaking furnace. The soaking furnace has: a heating zone for heating the steel pieces; a soaking zone being communicated to the heating zone and having a heat source for heating the steel pieces, which have been heated in the heating zone, at a higher temperature than in the heating zone for the soaking treatment, the soaking zone having a ceiling higher than a ceiling of the heating zone; and means for connecting the heating zone to the preheating chamber for feeding waste heat.

3 Claims, 11 Drawing Figures

APPARATUS FOR SOAKING STEEL PIECES

BACKGROUND OF THE INVENTION

This invention relates to an apparatus for soaking steel, in which cold steel pieces stored outside the arrangement are subjected to preheating treatment and subsequently to soaking treatment with or without hot steel pieces delivered from an ingot-making position.

Hitherto, the steel making furnace such as a converter, an open-hearth furnace, an electric furnace or the like has been operated in a batch-wise manner, so that different sorts of steel pieces have been discontinuously produced in the cogging factory. On the contrary, since the rolling mill is operated continuously, the soaked steel pieces must be always supplied continuously to the rolling mill. Thus, some of the excess steel pieces must be temporarily stored outside the arrangement, and an appropriate control of cooling and reheating of such the excess steel pieces is rather difficult, which considerably affects to quality and yield of the products in the subsequent rolling mill as well as the manufacturing capacity in the continuous operation. Furthermore, the so-called walking-beam furnace is known as a furnace useful for soaking treatment, which is designed to reheat the cold steel pieces passed through the cooling treatment. The furnace of this type has the disadvantages in that it heating capacity must be large, and in that the furnace inevitably includes movable components at high operational costs and thus is not tolerable with a labor-saving purpose.

In order to overcome these drawbacks the inventor proposed a method for soaking cold and hot steel pieces in U.S. Pat. No. 4,311,454 issued on Jan. 19, 1982. The soaking furnace and the heating furnace of these apparatus are designed to be high in their inner height so as to enhance an effect in radiative transfer to the steel pieces. Since the steel pieces are subjected to soaking treatment at a high temperature due to the radiative transfer in the soaking furnace, the temperature of waste heat exhausted from the soaking or heating furnace is rather high and heat of the waste gas cannot be sufficiently recovered in the preheating furnace, thus leading to a considerable loss of expensive thermal energy.

SUMMARY OF THE INVENTION

Accordingly, it is an object of the present invention to provide an apparatus for soaking steel pieces which apparatus enables soaking treatment in a high heat efficiency by efficiently using hot gas in a soaking furnace.

With these and other objects which will appear in the course of the specification, the present invention provides apparatus for soaking steel pieces including cold steel pieces and hot steel pieces. The apparatus is of the type which includes: a soaking furnace for subjecting the steel pieces to a soaking treatment; a preheating chamber for preheating the cold steel pieces before the cold steel pieces are introduced into the soaking furnace, the preheating chamber being connected to the soaking furnace for receiving waste heat from the soaking furnace for the preheating treatment and having an outlet portion for discharging the cold steel pieces; and means for introducing the steel pieces into the soaking furnace and for advancing the steel pieces through the soaking furnace. The soaking furnace comprises: a heating zone for heating the steel pieces; a soaking zone being communicated to the heating zone and having a heat source for heating the steel pieces, which have been heated in the heating zone, at a higher temperature than in the heating zone for the soaking treatment, the soaking zone having a ceiling higher than a ceiling of the heating zone; and means for connecting the heating zone to the preheating chamber for feeding waste heat.

Preferably, the connecting means connects the heating zone to the outlet portion of the preheating chamber. The connecting means may be a flue or a duct having a damper incorporated therein for opening and closing the duct.

The length of the heating zone may be defined by the formula:

$$L = \frac{t_1 - t_2}{K + \frac{t_1 - t_2}{15}}$$

where L is the length of the heating zone in meter, $t_1$ is a surface temperature in degree centigrade of the steel pieces just after the the steel pieces are discharged from the soaking furnace, $t_2$ is a surface temperature in degree centigrade of the steel pieces just before they are charged into the soaking furnace and K is a constant.

BRIEF DESCRIPTION OF THE DRAWINGS

The preferred embodiments of this invention will now be described by way of example with reference to the accompanying drawings in which.

DETAILED DESCRIPTION OF THE PREFERRED EMBODIMENTS

Figure 1:
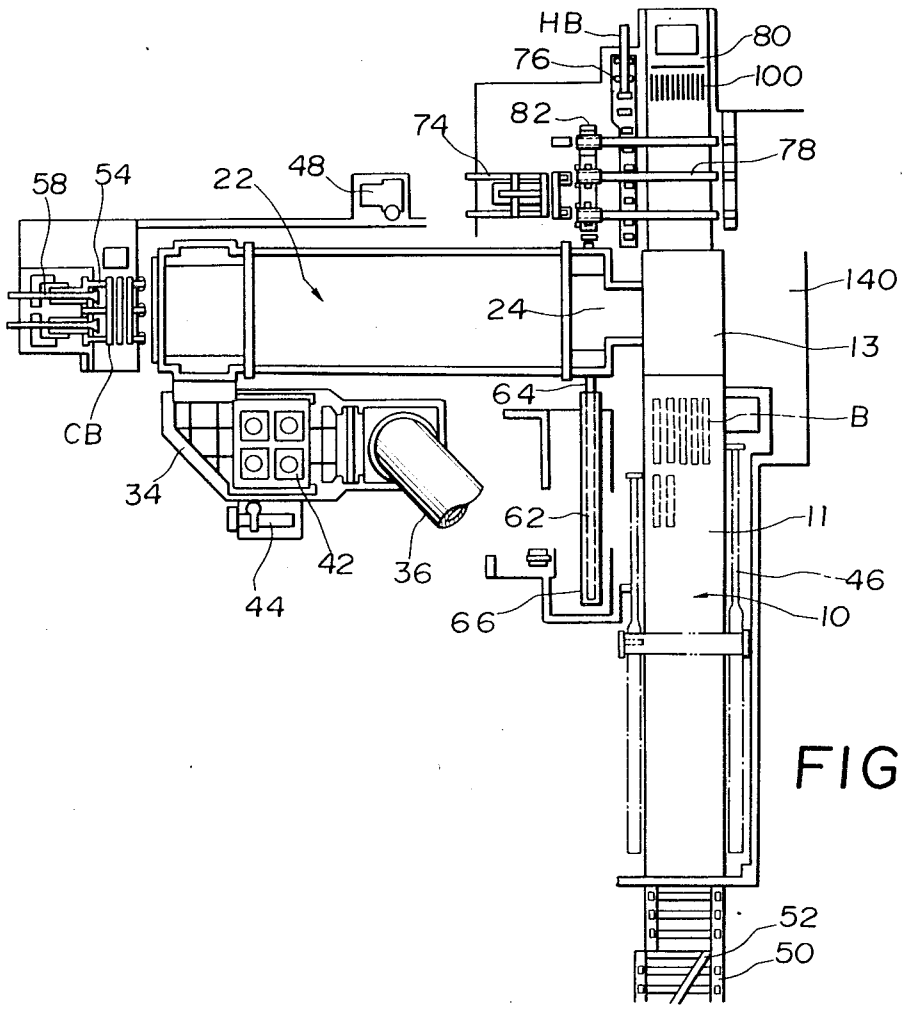
FIG. 1 is a plan view of the apparatus constructed according to the present invention.
Figure 2:
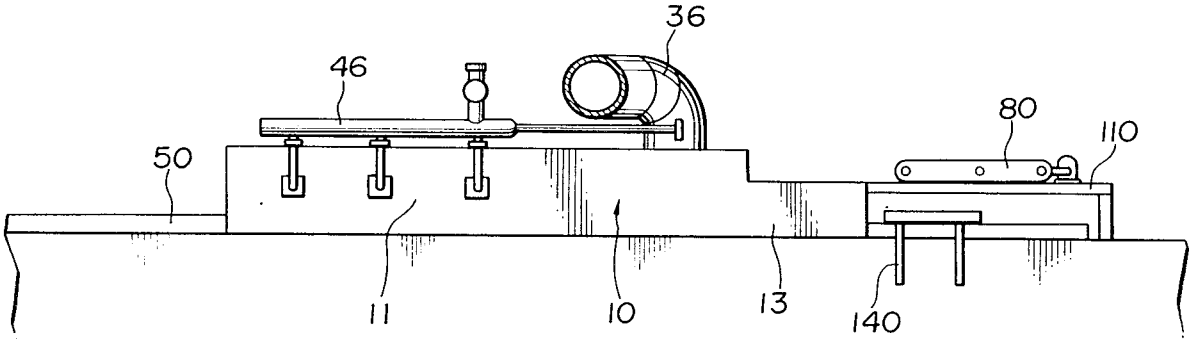
FIG. 2 is a side view of the apparatus in FIG. 1.

Referring to FIGS. 1–9 the reference numeral 10 designates a soaking furnace which generally includes a soaking zone 11 and a heating zone 13 continuously connected to the inlet of the soaking zone 11. The heating zone 13 has an inner furnace height smaller than the soaking zone 11. That is, the ceiling 11A of the soaking zone 11 is higher than the ceiling 13A of the heating zone 13. This feature will be described in more detail with reference to FIGS. 10 and 11 hereinafter.

Figure 4:
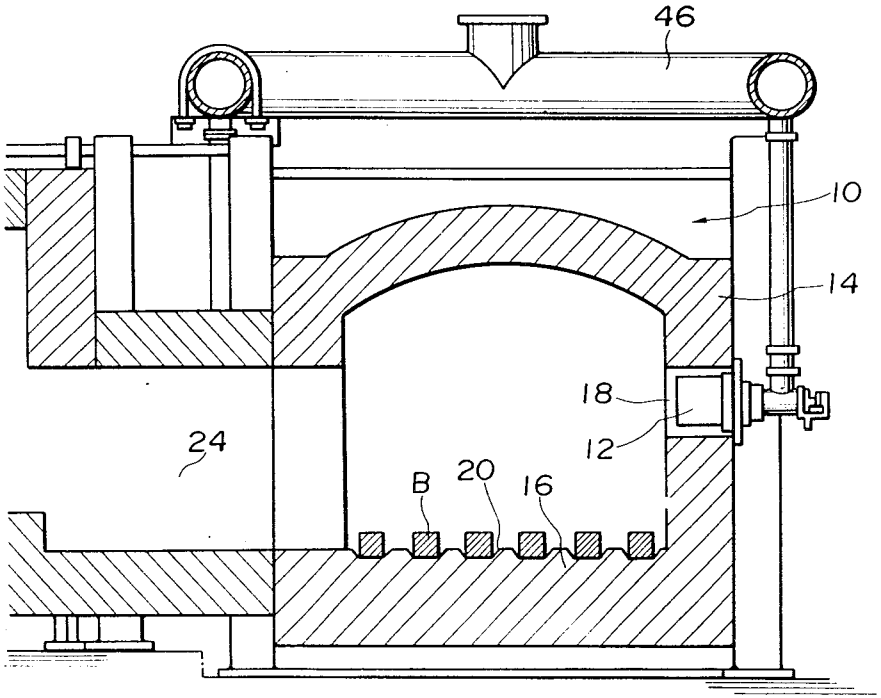
FIG. 4 is an enlarged vertical sectional view of the soaking furnace and the small flue in FIG. 3.

The furnace wall 14 and a bed 16 of the soaking furnace 10 are formed by stacking refractory bricks. The soaking zone 11 is provided at upper portions of a one sidewall thereof with a plurality of heating sources 12, such as an oil burner, for applying soaking treatment to steel pieces B such as blooms and billets. The heating sources 12 are respectively fitted into a plurality of burner openings 18 formed in the one side wall of the soaking zone 11 as best shown in FIG. 4. The burner openings 18 are disposed in a zigzag arrangement at predetermined intervals from the inlet to the outlet of the soaking zone 11. The bed 16 of the soaking furnace 10 is provided with a plurality of, six in this embodiment, troughs or grooves 20 extending in parallel with each other from the inlet to the outlet of the soaking furnace 10. Each trough 20 has a substantially trapezoidal section of which upper side is larger in width than the lower side thereof. The number of the troughs 20 is not limited to six, but may be determined in view of the heat capacity and the soaking time of the furnace 10, etc.

The provision of the soaking zone 11 and the heating zone 13 to the soaking furnace 10 considerably improves heat efficiency of the furnace. In the prior art soaking furnace, hot steel pieces HB at about 1150° C. are inserted into it, where the pieces are subjected to soaking treatment at a constant temperature of about 1200° C., with the result that the hot gas little drops in its temperature and the temperature of the gas exhausted from the soaking furnace to a preheating chamber is relatively high. Although cold steel pieces CB in the preheating chamber is heated by the waste gas from the soaking furnace, the higher the temperature of the gas introduced into the preheating chamber, the higher the temperature of the gas exhausted from the preheating chamber. Thus, in the prior art considerable quantities of expensive heat energy are exhausted to the atmosphere. According to the present invention, the heating zone 13, which is not provided with the heat source 12 and has a furnace ceiling lower than the ceiling of the soaking zone 11, is continuously connected to the inlet of the soaking zone 11. Steel pieces B charged into the soaking furnace 10 are first heated by convective heat transfer in the heating zone 13, to which is fed a hot gas from the soaking zone 11, and then further heated by radiative heat transfer to a higher temperature in the soaking zone 11 for soaking treatment. Thus, the steel pieces B are preheated in the heating zone 13 by convective heat transfer by the use of the hot exhaust gas from the soaking zone 11 before heating by radiative transfer while in the prior art steel pieces are heated only by radiative heat transfer. This feature of the present invention enhances heat efficiency of the soaking furnace. In a typical example, the temperature of cold steel pieces CB preheated in the preheating chamber 22 and discharged from it is about 850°–950° C. These cold steel pieces CB are heated to about 1150° C. by the hot gas having a temperature of about 1200° C. in the heating zone 13, and then subjected to soaking treatment at about 1200° C. in the soaking zone 11. In the heating zone 13 the hot gas is cooled by the heating of the cold steel pieces CB to about 1000°–1050° C. and then introduced into the preheating chamber 22. Thus, the gas which has heated cold steel pieces CB in the preheating chamber 22 is exhausted to the atmosphere at a low temperature as compared to the gas in the prior art, and hence the present invention is superior in heat efficiency to the prior art.

The length of the heating zone 13 is defined by the following formula:

$$L = \frac{t_1 - t_2}{K + \frac{t_1 - t_2}{15}}$$

where L is the length of the heating zone 13 (m), $t_1$ is the surface temperature of a hot steel piece HB when it is just extracted from the soaking furnace 10 (°C.), $t_2$ is the surface temperature of the hot steel piece HB just before it is charged into the soaking furnace 10 (°C.) and K is a constant (K=30 in this embodiment).

The refractory brick of the bed 16 is essentially made of the corhart brick or an electrofused refractory mullite brick. The bottom width of the troughs 20 is not less than that of the steel pieces B of substantially square-section and to be subjected to the soaking treatment. The steel pieces except the bottom surface thereof are well exposed to an adequate heat radiation in the soaking furnace 10 so that the steel pieces B are usually heated to the temperatures of 1,000° to 1,200° C.

In abutting and perpendicular relation to the soaking furnace 10 is arranged a preheating chamber 22 for preheating the cold steel pieces CB which are stored outside the apparatus and the preheating chamber 22 is communicated with the soaking furnace 10 through a small flue 24 through which a part of the hot gas in the soaking furnace flows into the preheating chamber 22. The small flue 24 is communicated at its one end with a middle portion of the heating zone 13 of the soaking furnace 10 and at its opposite end with an outlet of the preheating chamber 22, as best shown in FIG.1. The furnace 10, the chamber 22 and the small flue 24 are arranged so as to form a L shape as shown in FIG. 1. This normal relation in arrangement between the furnace 10 and the chamber 22 serves to simplify the transfer of the cold steel pieces CB since no turning movement of the objects is required but a mere vertical or horizontal movement of the article is sufficient. Namely, the cold steel piece CB is at first crossfed in the preheating chamber 22 and then pushed vertically at the outlet of the chamber 22 for entering into an inlet of the soaking furnace 10 with crossfeed movement for some distance, and finally transferred in the longitudinal direction in the soaking furnace 10. It will be appreciated that the L-shape arrangement between the furnace 10 and the chamber 22 ensures the most efficient flow of the hot gas from the furnace 10 into the chamber 22.

The wall 26 and the bed 28 of the preheating chamber 22 are made of the same refractory brick as that of the soaking furnace 10 and the bed 28 is provided with a plurality of tracks 30 extending longitudinally in parallel from the inlet to the outlet of the chamber 22. At the upper portion of the wall 26 are arranged a plurality of openings 32 for receiving oil-burners for additional heating to enhance the preheating capacity of the chamber 22.

As hereinbefore described, since the preheating chamber 22 is communicated with the soaking furnace 10 through the small flue 24, a portion of the heat is transmitted smoothly from the furnace 10 through the flue 24 into the chamber 22. Then the hot gas is moved from the outlet to the inlet of the preheating chamber 22 and is introduced through an overground flue 34 constructed in the vicinity of the inlet of the chamber 22 into an overground flue 36 laid on a base frame 38 which is constructed near the preheating chamber 22 and finally is exhausted into atmosphere through a chimney arranged (not shown). For the purpose of an effective utilization of the residual heat of the exhausted gas in the underground flue 34, the latter may be provided with an air-preheater 42 and a compressor 44, so that a hot air may be fed to the heat source 12 through a blower tube 46 arranged along the soaking furnace 10.

In FIG. 1, the reference numeral 48 represents a compressor arranged in abutment with the preheating chamber 22 for supplying a fresh air to the oil-burners for additional heating of the preheating chamber 22 when desired and the reference numeral 50 denotes a roller-table arranged at the outlet of the soaking furnace 10 for guiding the soaked steel pieces to the rolling mill (not shown) by means of a swingable guide rod 52.

At the inlet of the preheating chamber 22 is disposed a charging trestle 54 on which are placed pieces of the cold steel pieces CB is normal to a direction of movement thereof in the preheating chamber 22. Behind the trestle 54 is provided a crossfeed means 58 to push the cold steel pieces CB into the preheating chamber 22 for subsequent sliding toward the outlet of the preheating chamber 22. While the cold steel pieces CB are transferred along the tracks 30 in a crossfeed manner in the preheating chamber 22, all surface of each cold steel piece CB is exposed to the heat radiation so that it is preheated to the temperature of approximately 800° to 950° C.

Figure 3:
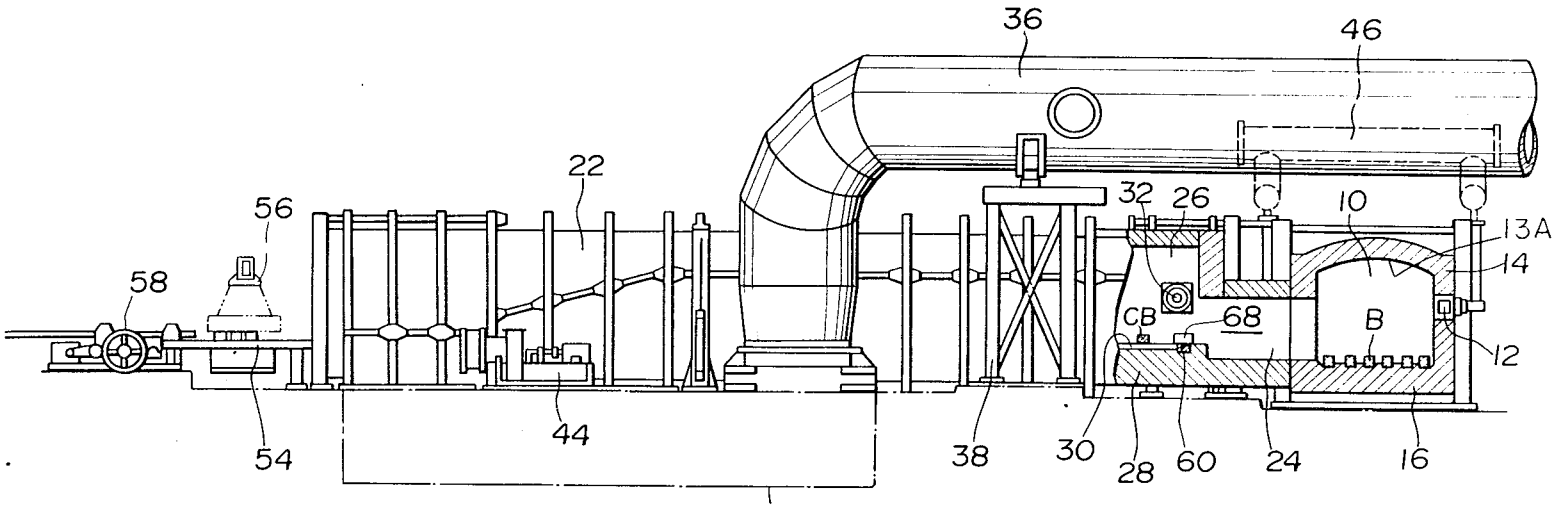
FIG. 3 is an enlarged front view, partly in section, of the apparatus in FIG. 1.

At the outlet of the preheating chamber 22, there is provided a rotating groove 60 which is in normal to the feeding direction of the cold steel pieces CB as shown in FIG. 3, so that the cold steel pieces CB fall into the groove 60, rotating 90° about its central axis. As a result, the surface of the steel piece CB which has contacted with the tracks 30 is raised to face with one side wall of the groove 60, as shown in FIG. 3.

Figure 5:
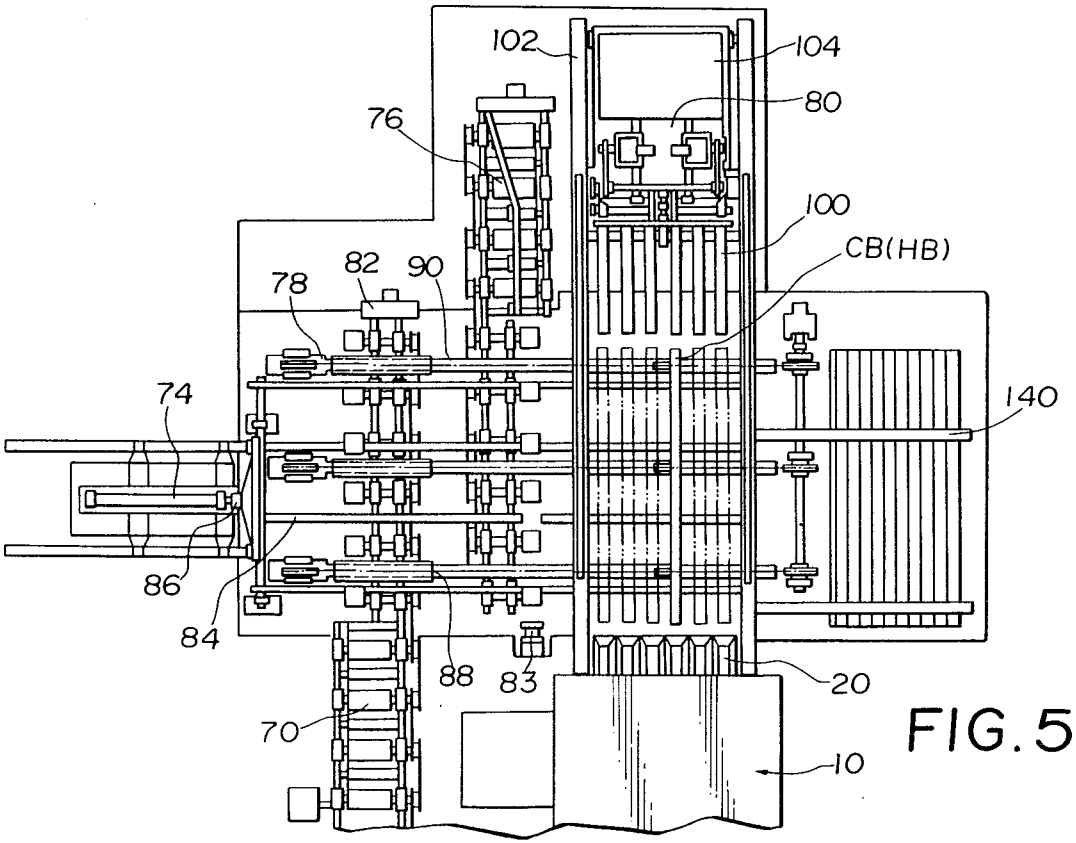
FIG. 5 is an enlarged plan view of the conveyor means with the feed roller-table and the charging means arranged in the vicinity of the inlet of the soaking furnace in FIG. 1.

In abutting relation to the outlet of the preheating chamber 22 is arranged a pushing means 62 which reciprocates to push individual steel pieces longitudinally along the groove 60. Namely, this pushing means 62 is disposed in juxtaposition into the soaking furnace 10. The pushing means 62 is provided at its distal end with an air-cooled pushing head 64 which is received in a cylinder 66 and movable through the groove 60 under the hydraulic pressure to push the preheated and rotated steel piece CB out of an opening 68 of the preheating chamber. As best shown in FIG. 5, in opposite to the pushing means 62 and along the soaking furnace 10, there is extended a roller conveyor 70 which is driven by a motor 72. The preheated steel piece CB is transferred longitudinally on the conveyor 70 driven by the motor 72 until it reaches to the vicinity of the inlet of the soaking furnace 10.

In the vicinity of the inlet of the soaking furnace 10 there are arranged several elements including a terminal of the conveyor means 70 at which the preheated and transferred steel piece CB is withheld, a pushing means 74 which pushes the steel piece CB to a rotation means for further rotation of the piece about its central axis for 90°, a feed roller-table 76 which supplies hot steel pieces HB from the ingot-making position, a crossfeed means 78 which carries the steel pieces CB and/or HB to the inlet position in alignment with the troughs 20 in the soaking furnace 10 and a charging means 80 for pushing the steel pieces into the soaking furnace 10.

To the terminal of the conveyor means 70 is fixed a stopper 82 by which the preheated steel piece CB carried from the preheating chamber 22 is prevented from further moving.

The terminal of the conveyor means 70 is placed in a parallel relation to the soaking furnace 10 as shown in FIG. 1. Further, the feed roller-table 76 is arranged between the terminal of the conveyor means 70 and the inlet of the soaking furnace 10 to intersperse the hot steel pieces HB when desired, directly or indirectly from the ingot-making position (not shown) and carry individual hot steel piece HB in parallel to the cold steel pieces CB.

Figure 6:
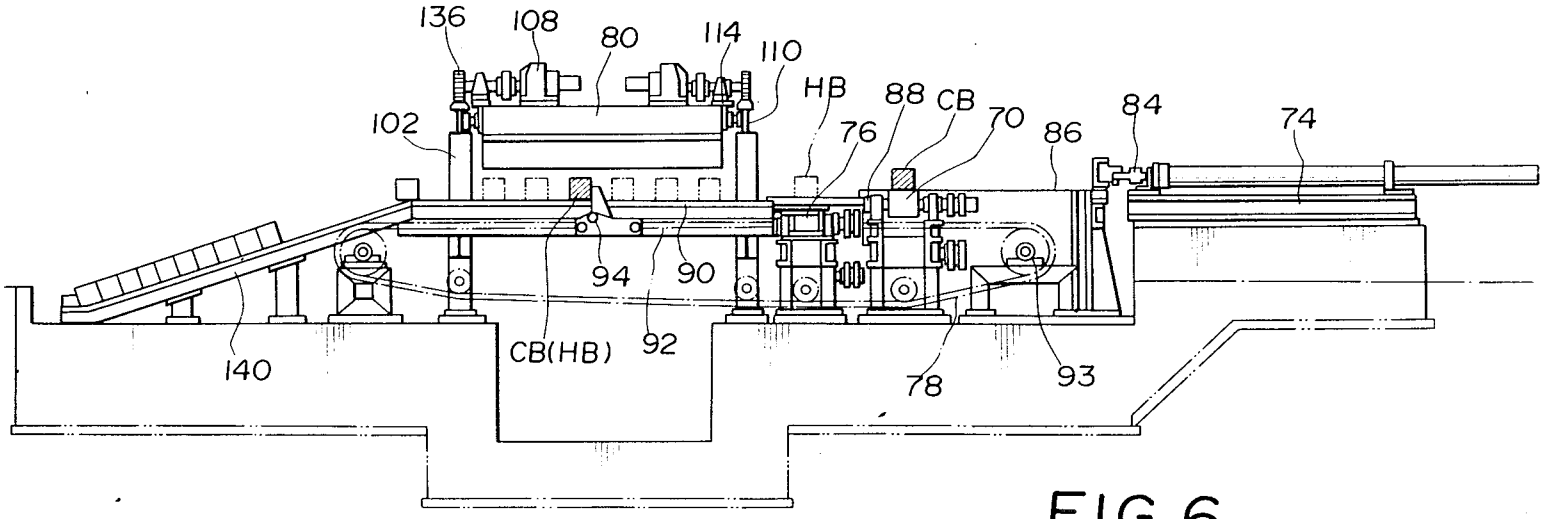
FIG. 6 is a partial rear view, in an enlarged scale, of the apparatus of FIG. 1
Figure 7:
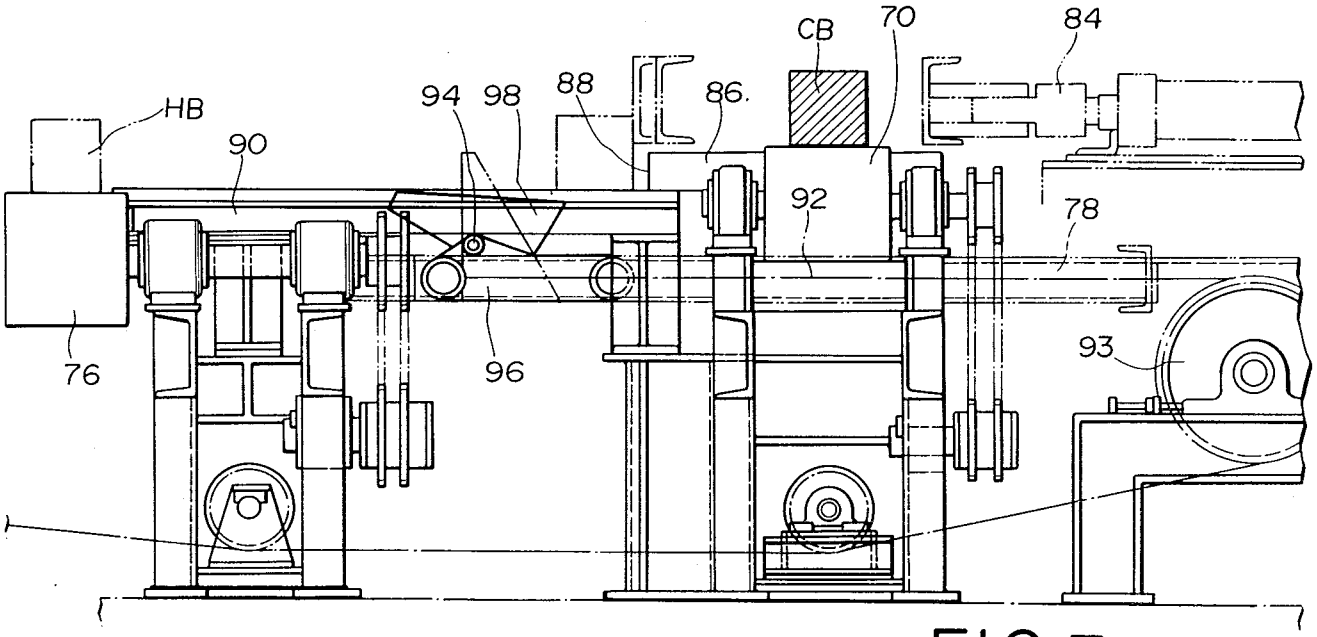
FIG. 7 is an enlarged rear view of the rotation means with the crossfeed means in FIG. 1.

Behind the terminal of the conveyor means 70, as best shown in FIG. 5, is arranged the pushing means 74 having a rod 84 which reciprocates under hydraulic pressure to push the steel piece. Further, at the terminal of the conveyor means 70 is arranged a slide rack 86 which comprises a plurality of aligned rails as shown in FIGS. 6 and 7. The slide rack 86 extends in normal relation to the conveyor means 70 and in the same level as that of the conveyor means 70. The preheated steel piece CB, when pushed by the rod 84, slides on the slide rack 86 and rotates again about its central axis for 90° by a second rotation means 88 formed at the end of the slide rack 86 as a step downed from a place of the slide rack 86. As hereinbefore described, since the steel piece CB has been already rotated at the first rotation means for 90°, the steel piece CB is rotated in total for 180° at the second rotation means. Thus, it will be appreciated that the bottom surface of the steel piece CB in the preheating chamber 22 comes to the top surface.

In the embodiment shown in FIG. 6, the second rotation means 88 is formed with a difference in height between the slide rack 86 and a transfer frame 90 as hereinafter fully described.

A second crossfeed means 78 is extended to the inlet of the soaking furnace 10, as shown in FIGS. 1 and 6 and is comprised of a feed frame 90 and a plurality of transfer lines 92. The feed frame 90 includes a plurality of skidrails arranged in alignment. The second rotation means 88 is disposed between the feed frame 90 and the conveyor means 70. The transfer lines 92 are movable forward and backward in normal to the direction of transfer of the steel pieces B in the soaking furnace by means of driving source 93 such as a motor with a plurality of foldable chain hooks 94 adapted to engage with the steel pieces.

When the slide rack 86 is not provided in the pusher 74, the feed frame 90 is directly connected to the upper surface of the conveyor means 70 through the second rotation means 88. On the other hand, when the slide rack 86 is used, the feed frame 90 is connected indirectly to the upper surface of the conveyor means 70 through the slide rack 86 as shown FIG. 6. In any way, the feed frame 90 is extended to the farmost troughs 20 in the soaking furnace 10 and is intersected with the feed roller-table 76. The transfer lines 92 are moved by a sprocket wheel and a tension gear along the feed frame 90 from the front position to the rear position so as to crossfeed the steel pieces to the inlet of the soaking furnace 10 in alignment with the troughs 20. The steel pieces CB and HB are optionally interspersed and controlled automatically or manually to arrive at a predetermined position in the inlet of the soaking furnace 10.

Each chain hook 94 is arranged between the chain blocks of the transfer line 92 in a desired position and includes a receiving block 96 connected to the adjacent chain blocks and a hook 98 foldably pivoted to the receiving block 96. Each hook 98 is of substantially triangle shape in cross section and stands up in case of the forward movement of the transfer lines 92 (counterclockwise direction as shown in FIGS. 6 and 7) while it lies down to the forward direction in case of the backward movement thereof. Thus, in case of the forward movement of the transfer lines 92, the hook 98 is raised in contact with the lateral surface of the steel piece for moving thereof into the inlet of the soaking furnace 10. On the other hand, in case of the backward movement, the hook 98 is pushed downwardly to the left in FIG. 7 by a certain obstacles such as the subsequent steel piece CB or HB or by a pusher-head 100 of the charging means 80. Such the folding movement of the hook 98 may be carried out by a momental difference due to the triangle shape of the hook 98 or by a mechanical manner such as a spring or lever or with the pneumatic or hydraulic pressure through an aperture to be provided for the receiving block 96.

Figure 8:
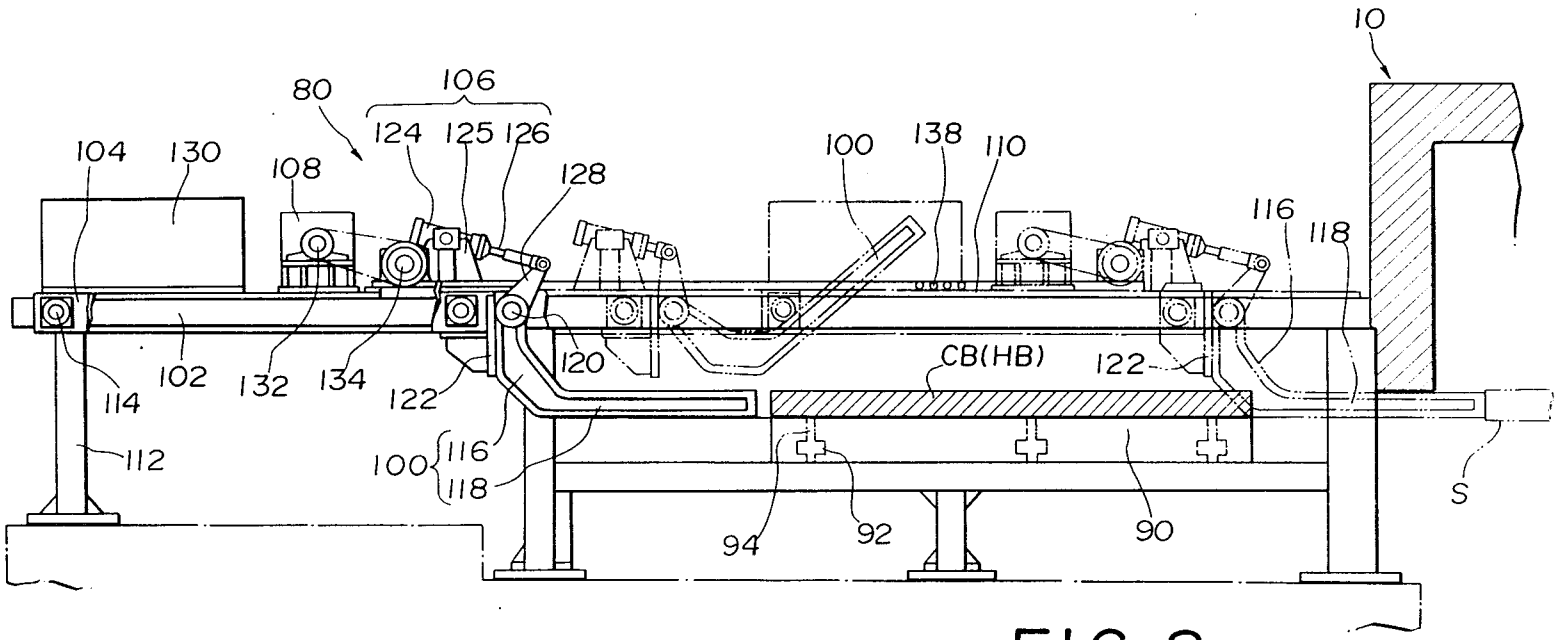
FIG. 8 is an enlarged side view of the charging means in FIG. 1.

In FIG. 8, the three transfer lines 92 are arranged in parallel with each other although more than four transfer lines may be employed and in some designs the single or two transfer lines may also be used if the cold steel piece CB or the hot steel piece HB is crossfed without any rotation. The width of the second crossfeed means 78 may preferably be enlarged in order to transfer the steel pieces of different lengths.

In this embodiment, the feed roller-table 76 is arranged in normal to the feed frame 90 and in the same place so that the preheated steel piece CB on the conveyor means 70 and the hot steel piece HB on the feel roller-table 76 may either or alone be crossfed by the common crossfeed means 78 for simplification of the arrangement. However, the arrangement of the conveyor means 70, the feed roller-table 76, the second crossfeed means 78, etc is not restricted to the illustrated embodiment.

The steel pieces withheld at the predetermined position on the feed frame 90 are charged into the soaking furnace 10 by the charging means 80 which is automatically moved in the longitudinal direction of the soaking furnace 10. For this purpose, the charging means 80 is comprised of a rail frame 102, a vehicle 104 running thereon, a plurality of pusher-heads 100 relievably and swingably attached to the front of the vehicle, a swing mechanism 106 such as a pneumatic cylinder for relievably swinging the pusher-heads 100 along the rail frame 102 and a driving mechanism 108 such as a hydraulic motor mounted on the vehicle 104 for moving thereof.

The rail frame 102 is extended along the same direction as the direction of transfer of the steel pieces to the inlet port of the soaking furnace.

The rail frame 102 is positioned in normal to the feed frame 90 and includes a pair of H-shaped rails 110 which are laid on a plurality of supports 112 arranged in the front of the soaking furnace 10 as shown in FIG. 8. The width between the rails is not less than that of the soaking furnace 10 and particularly the total width of the whole paralleled troughs 20. The rails 110 have such a height that a tip of each pusher head 100, when fallen down, is made into contact with an end face of the corresponding steel piece on the feed frame 90. Thus, the steel pieces are pushed by the pusher-heads during the forward movement of the vehicle 104. However, the pusher-heads 100 when lifted do not contact with the steel pieces as shown in FIG. 8.

The vehicle 104 is constructed, for example, by assembling shape steels of convenient shape into a lattice form and is placed on the rail frame 102 by fitting four corner elements 114 into the grooves of the rails 110 as shown in FIGS. 6 and 8.

Figure 9:
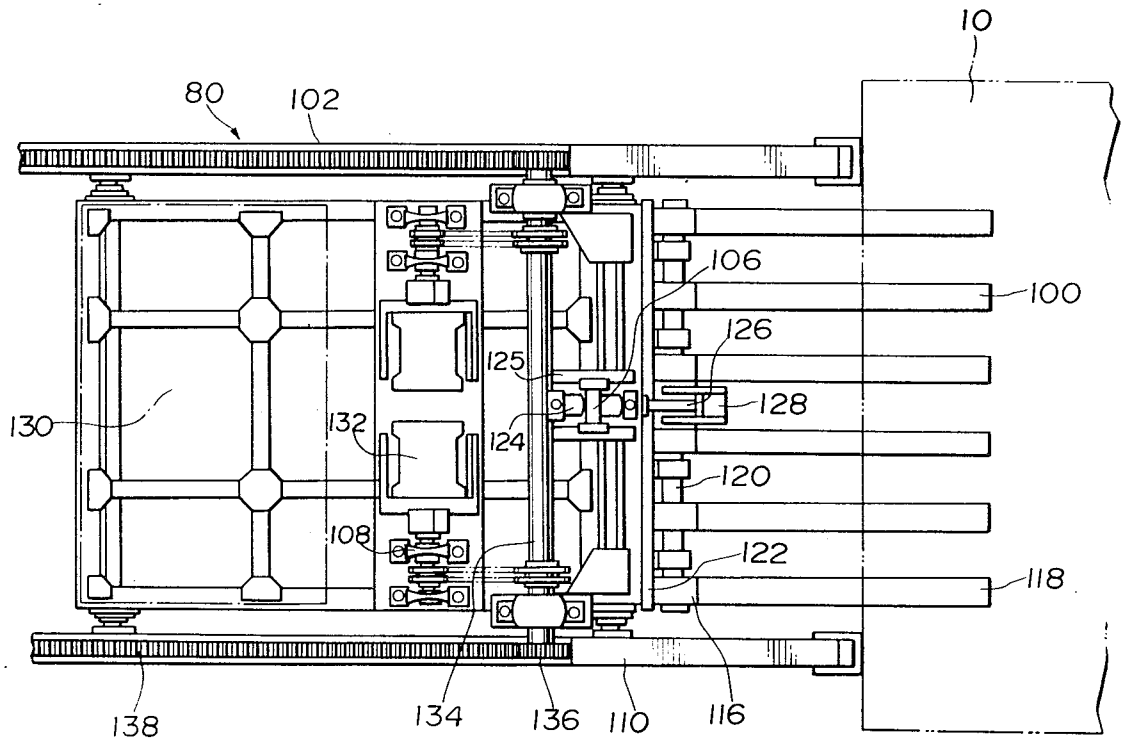
FIG. 9 is a plan view of the charging means in FIG. 8.

In FIG. 8 and 9, the six pusher-heads 100 are illustrated to correspond to the six paralleled troughs 20 arranged in the soaking furnace 10. Each pusher-head 100 is formed into a substantially L-shaped body, with a fixing member 116 and a pushing rod 118. The upper end of the fixing member 116 is fixed to a swing shaft 120 pivoted to the swing mechanism 106. The front end of the pushing member 118 or the free end of the pusher-head 100 is made into contact with the steel piece.

As apparent from FIG. 8, the corner of the L-shaped body of each pusher-head 100 may preferably be cut off in such a way that the cut line becomes parallel to the feed frame 90 when the pusher-head 100 is lifted so that steel pieces B may be conveniently passed under the pusher-head. Thus, the height of the rail frame 102 may be reduced as low as possible and as a result the swing range of the pusher-heads 100 may be reduced.

From the front of the vehicle 104 is suspended a blocking plate 122 which is made into contact with a rear face of the fixing piece 116 of each pusher-head 100 to prevent the downward relief of the pusher-head 100 when the cold steel pieces CB or the hot steel pieces HB are charged into the soaking furnace 10.

The pusher-heads 100 may be of any shape such as a triangular or a rod like shape provided that the pusher-heads 100 have a strength sufficient enough to endure the load of the steel pieces on transportation in series in the soaking furnace and have such a size which permits the steel pieces to pass under them when the pusher-heads 100 are lifted.

The swing movement of the pusher-heads 100 is brought by means of the swing mechanism 106 fixed to the front of the vehicle 104. The swing mechanism 106, as illustrated in FIG. 8, is comprised of an air-cylinder unit which includes a cylinder 124 and a rod 126. The cylinder 124 is pivoted between a pair of support frames 125 at the front center of the vehicle 104 and reciprocates the rod 126 which is linked to an intermediate member 128 secured to the swing shaft 120. The operation of the swing mechanism 106 is associated with the forward or backward movement of the vehicle 104. Thus, when the vehicle 104 is moved toward the soaking furnace 10, the rod 126 of the swing mechanism or air-cylinder unit 106 is stretched to move the swing shaft 120 through the intermediate member 128 to swing down each pusher-head 100 making the tip of the pusher-head 100 into contact with the corresponding steel piece for charging the same into the soaking furnace 10. On the contrary, when the vehicle 104 is moved backward apart from the soaking furnace 10, the rod 126 enters into the cylinder 124 thereby to move the pusher-head 100 in the lifted position.

With such a construction, the pusher-heads 100 are moved together by the single swing mechanism, resulting in obtaining a simple construction with high efficiency and convenient maintenance and inspection.

The forward movement of the vehicle 104 permits the pusher-heads 100 to pass the steel pieces into the soaking furnace 10. The high temperature atmosphere in the soaking furnace 10 makes it difficult to arrange any transportation means therein, so that the steel pieces in the soaking furnace are pushed ahead in series by the pusher-heads 100 and are finally pushed out of the soaking furnace 10 seriatim. Accordingly, the vehicle 104 must have a power sufficient enough to push all the steel pieces from the inlet port to the outlet of the soaking furnace 10.

Preferably, a convenient hydraulic motor is employed as the driving mechanism 108 in order to avoid a slippage or an idle-running of the vehicle 104 and also to avoid any interruption of the operation due to the over load of the steel pieces B. This driving mechanism includes an oil unit 130, a pair of hydraulic motors 132 arranged at the opposite sides of the vehicle 104 and a running shaft 134 having wheels 136 which are engaged with the rail frames 102. The running shaft 134 is rotatably journaled by the vehicle 104 to rotate through the chain transmission from the motor shaft. Each wheel 136 is provided with a gear to coact with a rack 138 formed on the upper surface of the rail 110 of the rail frame 102. Thus, the driving force obtained by the hydraulic motor 132 positively advances the vehicle 104 under the resistance of the load of the steel piece B.

The charging means 80 and the second crossfeed means 78 are controlled so that the steel pieces are crossfed at least by the crossfeed means 78 before the forward movement of the charging means 80 is commenced. In order to avoid cooling of the steel pieces before entering into the soaking furnace 10, the preheated steel pieces may preferably be charged quickly into the soaking furnace 10.

For this purpose, the second crossfeed means 78 moves the steel pieces to the inlet of the soaking furnace 10, while the charging means 80 per se is returning to its starting position. On the other hand, the charging means 80 moves the steel pieces into the soaking furnace 10, while the crossfeed means 78 is returning to its starting position. In other words, there is provided such a control cycle that the backward movement of the second crossfeed means 78 is carried out in synchronous with the forward movement of the charging means 80, and vice versa. In particular, while the charging means 80 is moving backward, the pusher-head 100 is raised to form the space which permits passing of the steel pieces, so that the crossfeed means 78 moves the steel pieces to the predetermined position on the feed frame 90 at the entrance of the soaking furnace 10. On the other hand, while the charging means 80 is moving forward with the backward movement of the crossfeed means 78 to its starting position, the chain hooks 94 of the transfer lines 92 takes the fallen position when the crossfeed means 78 comes into contact with the hot steel piece HB which are supplied on the feed frame 90 or practically on the feed roller table 76.

The reference numeral 140 represents a pass line arranged in confront to the pushing means 74 as illustrated in FIGS. 1 and 5 and the upper surface of the pass line is connected to the upper surface of the feed frame 90 of the crossfeed means 78. The pass line 140 temporally holds, for example, when the operation of the rolling mill is discontinued due to an accident, the preheated steel pieces CB or the hot pieces HB supplied by the crossfeed 78 across the inlet path to the soaking furnace 10, thereby to ensure further continuation of the preheating or ingot-making operation.

The procedures for soaking the cold steel pieces CB stored outside the apparatus and/or the hot steel pieces HB delivered from the ingot-making position will be fully described. In normal to the preheating chamber, a cold steel piece CB is placed by means of the crane 56 on the charge trestle 54 arranged at the entrance of the preheating chamber 22 and is then crossfed into the chamber 22 by means of the pushing means 58 for further transfer through the preheating chamber in which steel piece CB is preheated to 800°-950° C. with the heat introduced from the soaking furnace 10 through the small flue 24. Thereafter, the steel piece CB rotates about its central axis by 90° at the first rotation means 60 arranged in the outlet of the preheating chamber 22. Then the preheated steel piece CB is pushed out of the groove 60 through the opening 68 onto the conveyor means 70 juxtaposed to the soaking furnace 10 for transfer until it is withheld in the vicinity of the inlet of the soaking furnace 10 by means of the stopper 82 arranged at the terminal of the conveyor means 70.

The steel piece CB placed on the terminal of the conveyor means is further pushed by the pushing means 74 onto the slide way 86 to rotate further by 90° at the second rotation means 88 for placement on the feed frame 90 of the second crossfeed means 78.

Meanwhile, hot steel piece HB, which has been manufactured in the ingot-making factory, is transported on the feed roller-table 76 arranged in parallel to the conveyor means 70 until it is withheld by the stopper 82 on the feed roller-table 76 arranged in parallel to the cold steel piece CB. Thus, the cold and hot steel pieces CB and HB are interspersed here since the feed roller-table 76 and the feed frame 90 have the common upper surface plane.

When the second crossfeed means 78 is commenced to operate, the chain hook 94 of the transfer lines 92 moves the steel piece CB or HB on the feed frame 90 until it is withheld at the predetermined position in the entrance of the soaking furnace 10 in alignment with the paralleled troughs 20. Even when the steel piece CB or HB on the feed frame 90 is transported seriatim, the transfer of the steel piece can be carried out rapidly without any spontaneous cooling.

The charging means 80 then moves forward with the pusher-heads 100 in the fallen position and contacting with the steel pieces for entering into the soaking furnace 10. After the charging cycle is terminated, the charging means 80 moves backward with pusher-heads 100 in the lifted position to wait at the rear position of the rail frame 102 until the next charging cycle. Meanwhile, the transfer lines 92, which has returned to its starting position during the forward movement of the charging means 80, moves the steel pieces into the inlet of the soaking furnace 10. These operations are repeated to charge the steel pieces CB and /or HB successively into the soaking furnace 10.

The charging and soaking of the steel pieces are carried out in the following way. Namely, the steel pieces are placed in the troughs 20 seriatim from the inlet to the outlet of the soaking furnace 10 and then pushed by the succeeding steel pieces pushed by the charging means 80 and finally delivered from the soaking furnace seriatim onto the roller-table 50 arranged at the delivery thereof.

Figure 10:
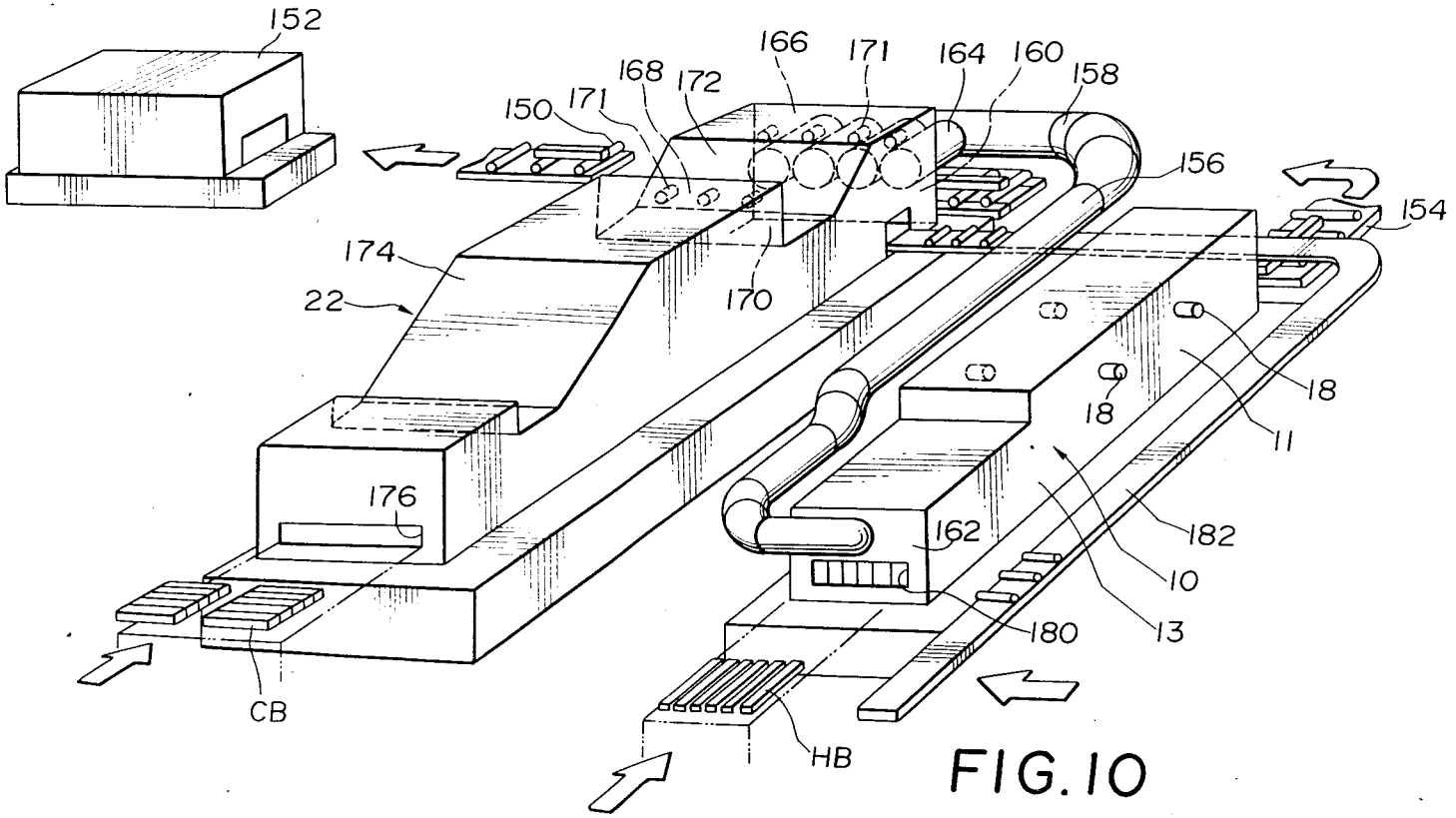
FIG. 10 is a perspective view of another embodiment of the present invention.

Another embodiment of the present invention is illustrated in FIG. 10, of which parts similar to parts already described in connection with the preceding embodiment are designated by like reference numerals and description thereof is omitted. In this embodiment, hot steel pieces HB usually having a temperature of about 900°-1000° C. are transferred from, for example, a continuous coasting machine to the soaking furnace 10 by means of a roller table of the type already described and then successively and longitudinally charged in columns into the soaking furnace 10 by means of a hydraulic charging pusher (not shown). The hot steel pieces HB are heated to about 1150°-1250° C. in the soaking furnace, from which they are then forcedly discharged.

Thereafter, the hot steel pieces HB are transported by a roller table 150 to a rolling mill 152 after the change of the transporting direction by means of a conventional direction change device 154.

In this embodiment, the preheating chamber 22 is disposed in parallel with the soaking furnace 10. Heating furnaces already existing may be used as the preheating chamber 22, in which cold steel pieces CB having a normal temperature is heated to about 1000° C. The preheating chamber 22 is communicated to the heating zone 13 of the soaking furnace 10 through a closable waste heat duct 156 as a flue for introducing waste heat from the soaking furnace 10 into the preheating chamber 22. The waste heat duct 156 is provided on the inner face thereof with refractory lining for heat resistance and at an intermediate portion thereof with a damper 158 so as to be operable from the outside for opening and closing the inner passage thereof. The waste heat duct 156 connects the rear wall 160 of the preheating chamber 22 to the front wall 162 of the heating zone 13 of the soaking furnace 10, and the duct 156 is attached to the rear wall 160 of the preheating chamber 22 through a manifold pipe 164 having several branch pipes, which enable the waste heat is evenly introduced into the preheating chamber 22 from the outlet toward the inlet of that chamber. Therefore, cold steel pieces CB, which are being gradually heated as they advance from the inlet to the outlet of the preheating chamber 22, are subjected to efficient preheat treatment.

The preheating chamber 22 is provided with two burner zones 166 and 168, one burner zone 166 being formed at an upper portion of the rear wall 160 and the other 168 at an intermediate vertical wall 170 of the preheating chamber 22. The burner zones 166 and 168 are each provided with burners 171 using a gas or a heavy oil as a fuel. The preheating chamber 22 is covered with two inclined top or ceiling walls 172 and 174 spaced from the burner zones 166 and 168, respectively. The front end of each inclined wall is located to be lower than the rear end thereof so that gases from the burners 171 are gradually directed forwards toward the furnace bed. The burners 171 are to apply additional heating to cold steel pieces CB. The preheating chamber 22 may be provided with more than two burner zones. The cold steel pieces CB, which have thus heated to about 1000° C. by the preheating chamber 22, are transferred to a position adjacent to the inlet 180 of the soaking furnace 10 by a roller table 182 and are then charged into that furnace, where the cold steel pieces are subjected to heating treatment together with hot steel pieces HB, after which they are transported to the rolling mill 152 through change-direction device 154 and roller table 150.

When hot steel pieces HB are not supplied to the soaking furnace 10, waste heat from that furnace is not available and cold steel pieces CB are subjected to soaking treatment only by the burner 171 in the preheating chamber 22, after which they are successively discharged from an outlet (not shown) formed at the rear wall 160 of the preheating chamber 22 and then placed on the roller table 140 for transference to the rolling mill 152.

In this embodiment, it is possible to carry out heating treatment of steel pieces by operating only the soaking furnace 10 and further by closing the waste heat duct 156 by means of the damper 158, heating and soaking treatments may be made in the preheating chamber 22 without operating the soaking furnace 10. According to this embodiment, furnaces already constructed only for heating may be used as preheating chamber 22 by additionally providing the soaking furnace 10 and the waste heat duct 156, thereby easily providing efficient soaking treatment and enabling reduction in initial and running cost of the provisions since any moving device of the furnace bed as in the walking beam furnace and the auxiliary facilities such as water cooling devices and drive devices are not necessary. The additional heating is carried out toward the inlet 176 of the preheating chamber 22 by means of a plurality of burners 172 directed forwards and is hence efficient.

Although the delivery section of the preheating chamber 22 is maintained at a relatively high temperature by the heat from the soaking furnace, the temperature at the inlet section of the preheating chamber 22 is rather low, so that the preheating treatment of the cold steel pieces is commenced at a relatively low temperature in order not to deteriorate the composition of the cold steel pieces CB, with the result that production of the oxidized layer is fairly suppressed.

Figure 11:
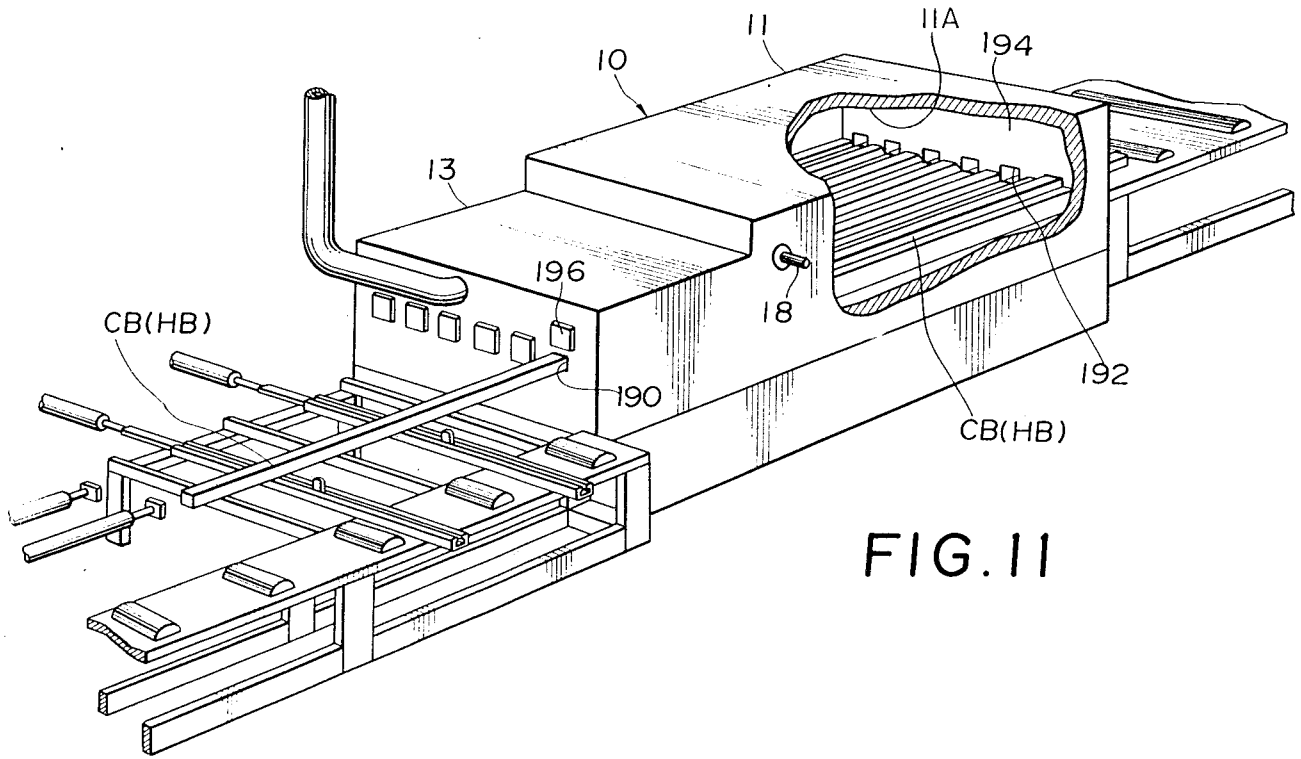
FIG. 11 is a modified form of the soaking furnace of FIG. 10.

As shown in FIG. 11, the front end wall 162 of the soaking furnace 10 may be provided with a plurality of charging openings 190 as the inlet 180. To each charging opening 190 there is provided a cover plate or door 196 automatically opening and closing the opening 190 in response to the charging of the steel pieces CB and HB. Such cover plates may be further provided to discharge opening 192 formed in the rear wall 194 of the soaking furnace 10.

While the invention has been disclosed in specific detail for purposes of clarity and complete disclosure, the appended claims are intended to include within their meaning all modifications and changes that come within the true scope of the invention.

What is claimed is:

1. An apparatus for soaking steel pieces including cold steel pieces and hot steel pieces, the apparatus being of the type which includes: a soaking furnace for subjecting the steel pieces to a soaking treatment; a preheating chamber for preheating the cold steel pieces before the cold steel pieces are introduced into the soaking furnace, the preheating chamber being connected to the soaking furnace for receiving waste heat from the soaking furnace for the preheating treatment and having an outlet portion for discharging the cold steel pieces; and means for introducing the steel pieces into the soaking furnace and advancing the steel pieces through the soaking furnace, the improvement wherein the soaking furnace comprises:

(a) a heating chamber having a first ceiling, first sidewalls and one end having an inlet for the steel pieces;

(b) a soaking chamber integrally formed with the heating chamber, the soaking chamber communicating with the heating chamber so that the heat energy is fed from the soaking chamber to the heating chamber and so that the steel pieces are movable from the heating chamber to the soaking chamber, the soaking chamber having a second ceiling, second side walls, heating means for heating the steel pieces and an outlet, formed at one end thereof remote from the heating chamber, for discharging the steel pieces, the soaking chamber being aligned with the heating chamber along a line of travel of the steel pieces from the inlet of the heating chamber to the outlet of the soaking chamber;

(c) means for connecting the one end of the heating chamber to the outlet portion of the preheating chamber for feeding waste heat from the heating chamber to the preheating chamber, and wherein;

the soaking chamber defines a unitary space, the heating means is disposed at an upper portion of one of the second side walls of the soaking chamber; and the second ceiling of the soaking chamber is higher than the first ceiling of the heating chamber, whereby a radiative heat zone is produced at a portion near the second ceiling within the soaking chamber when the heating means is operated, thus soaking mainly by radiative heat transfer the steel pieces, which have been heated in the heating chamber mainly by convective heat transfer due to the heat energy fed from the soaking chamber, at a higher temperature than in the heating chamber.

2. An apparatus for soaking steel pieces as recited in claim 1, wherein the soaking furnace is disposed to be perpendicular to the preheating chamber with respect to the line of travel of the steel pieces, and wherein the connecting means is a flue for feeding the waste heat from the heating zone to the preheating chamber.

3. An apparatus for soaking steel pieces as recited in claim 2, wherein the connecting means is a duct having a damper incorporated therein for opening and closing the duct.

* * * * *